350-377 SR
3/11/86 XR 4,575,722

United States Patent [19]

Anderson

[11] Patent Number: 4,575,722

[45] Date of Patent: Mar. 11, 1986

[54] MAGNETO-OPTIC DISPLAY

[75] Inventor: Robert H. Anderson, Long Beach, Calif.

[73] Assignee: Litton Systems, Inc., Beverly Hills, Calif.

[21] Appl. No.: 375,325

[22] Filed: May 5, 1982

[51] Int. Cl.[4] ..... G09G 3/20

[52] U.S. Cl. ..... 340/783; 340/705; 340/716; 340/700; 358/92; 350/377

[58] Field of Search ..... 340/700, 705, 763, 783; 358/88, 92, 91; 350/132, 331 R, 514, 515, 516, 517; 352/60

[56] References Cited

U.S. PATENT DOCUMENTS

| | | | |
|---|---|---|---|
| 2,735,337 | 2/1956 | Frischmann | 350/514 |
| 3,495,891 | 2/1970 | Lee | 350/517 |
| 3,851,955 | 12/1974 | Kent et al. | 352/60 |
| 3,858,001 | 12/1974 | Bonne | 358/92 |
| 4,170,772 | 10/1979 | Bly | 340/783 |
| 4,274,092 | 6/1981 | Vonusa et al. | 340/705 |
| 4,309,084 | 1/1982 | Hill | 350/377 |
| 4,322,726 | 3/1982 | Collier et al. | 340/700 |

*Primary Examiner*—Gerald L. Brigance

[57] ABSTRACT

A display adapted to be helmet-mounted or used for projecting and having the multi-mode capability of full three-primary color displays; gray scale or halftones; stereo imagining; image processing; split-screen operation; blink comparator; see-through, heads-up viewing; and night-vision intensification combined with alphanumerics. A bulb in a reflective housing illuminates a plastic diffusion screen to create a light beam. An electronic alterable, random-access storage display chip is placed in line with the emerging beam. The display chip comprises a film sandwich configuration consisting of a sheet polarizer, a magneto-optic chip with addressible alterable areas, and a sheet polarization analyzer. Signals received from a radio link are applied through a cable and connectors to the chip. By driving the chip as a function of the desired display, the display is impressed on the beam of light which may then be split and passed through appropriate focusing lenses for viewing or projected. Multiple beams, multiple display chips, and multiple layered chips with filtering are employed to create various operating modes.

34 Claims, 23 Drawing Figures

(a)

(b)

MAGNETO-OPTIC DISPLAY

BACKGROUND OF THE INVENTION

The present invention relates to display systems and, more particularly, to personal display systems of a lightweight nature adapted for carrying or wearing on the person.

With contemporary sophisticated electronic weaponry, there is a continuingly increasing need to provide information in visual form to equipment users. Ideally, such display equipment should be lightweight, rugged, and able to convey information by superimposing it on the normal field of vision.

It is the principle object of the present invention to provide such a personal display system.

It is also an object to provide a lightweight display system for projection of a display image or direct viewing.

SUMMARY

The foregoing principle objective has been met by the binocular display of the present invention comprising a source producing a first beam of light; first polarizer means disposed in the first beam for polarizing the light in the first beam; first magneto-optic chip means disposed in the first beam after the first polarizer means for selectively altering the axis of polarization of the first beam passing through addressible areas of the first chip, the first chip including means adapted to be operably connected to a first display driver for addressing the addressible areas whereby the first chip can be driven to alter the axes of polarization of the areas as a function of a desired first display; first polarization analyzer means disposed in the first beam after the first chip means for blocking or passing portions of the first beam corresponding to respective ones of the areas to which they have passed as a function of the altering of the axes of polarization performed by the respectives one of the areas whereby the desired first display is imparted into the first light beam; first beam splitter means disposed in the first beam for splitting the beam into first and second partial-intensity beams; and, focusing means disposed in the first and second partial-intensity beams for viewing the first display contained within the first and second beams.

For convenience of wearing, the components of the display are contained in a housing including means for attaching the housing to the head of a viewer. Typically, this is by attaching the housing to a helmet to be worn on the head.

To further accomplish the objectives, a half-silvered mirror is disposed in the beam after the focusing means whereby a viewer can look through the mirror and see the display superimposed on his normal field of vision. In the preferred embodiment, the mirror is mounted for movement between the aforesaid position disposed in the first and second beams and a position removed from both the viewer's line of sight and the beams.

To provide more detail and information conveying displays, in the preferred embodiment, the display additionally comprises a source of producing a second beam of light; second polarizer means disposed in the second beam for polarizing the light in the second beam; second magneto-optic chip means disposed in the second beam after the second polarizer means for selectively altering the axes of polarization of the second beam passing through addressible areas of the second chip, the second chip including means adapted to be operably connected to a second display driver for addressing the addressible areas whereby the second chip can be driven to alter the axes of polarizatin of the areas as a function of a desired second display; second polarization analyzer means disposed in the second beam after the second film means for blocking or passing portions of the second beam corresponding to respective ones of the areas through which they have passed as a function of the altering of the axes of polarization performed by the respective ones of the areas whereby the desired second display is imparted into the second light beam; and wherein, the first beam splitter means is disposed in both the first and second beams whereby the first and second beams are split into first, second, third, and fourth partial-intensity beams with the first and third and the second and fourth partial-intensity beams being superimposed upon one another.

For projecting, the light sources are increased in intensity and the binocular path is replaced by a single projection focusing lens.

DESCRIPTION OF THE VARIOUS EMBODIMENTS

Figure 1:
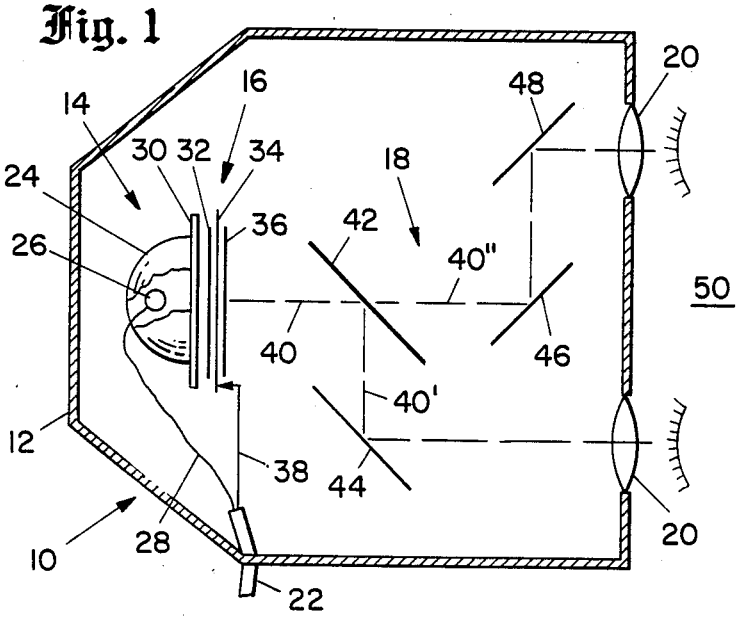
FIG. 1 is a cutaway plan view through a binocular display of the present invention in its simplest embodiment.

Referring first to FIG. 1, a binocular display 10 according to the present invention in its simplest embodiment is shown. Display 10 comprises a housing 12 containing a source of illumination 14, a magneto-optic display chip 16, a plurality of mirrors, generally indicated as 18, and a pair of spaced focusing lenses 20 through which the display can be viewed. A cable 22 passes through the housing 12 and is operably connected to the source of illumination 14 and the magneto-optic display chip 16 on the inside. The other end of cable 22 is adapted to be connected to a display driver (not shown).

The source of illumination 14 comprises a reflector shell 24 containing a bulb 26 therein which is connected to wire 28 contained in cable 22. Other forms of illumination could, of course, be employed. Across the front of the reflector shell 24 is a translucent diffusion sheet 30. The display chip 16 comprises a polarizing sheet 32 followed by a magneto-optic chip 34 and then a polarization analyzer sheet 36. Preferably, the two sheets 32, 36 are positioned on opposite sides of the chip 34. The magneto-optic chip 34 is operably connected to addressing wires 38 contained in the cable 22. The construction and operation of a display chip such as 16 can be seen in greater detail by reference to copending applications Ser. No. 320,819, Filed Nov. 12, 1981, by B. E. MacNeal and W. E. Ross titled ALTERING THE SWITCHING THRESHOLD OF A MAGNETIC MATERIAL assigned to the assignee of the present invention. Further modifications to the display chip 16 to realize the benefits of the present invention are to be described hereinafter. Basically, the polarizing sheet 32 polarizes the light from the source of illumination 14 along one axis. The polarization analyzer sheet 36 is also a polarizing sheet which is disposed with its polarization axis at approximately 75° to the polarization axis of the polarizing sheet 32. As is well known, if two sheets of polarizing film are placed with their polarization axes at 90° to one another, virtually no light will pass therethrough. On the other hand, if they are placed with their axes of polarization in alignment, the sheets will appear relatively transparent. As the axes are moved between the alignment position and the 90° relationship relative to one another, they increasingly block the passage of light therethrough. The magneto-optic chip as described in detail in the above-referenced copending patent applications, comprises a solid-state sheet of material having addressing wires connected in a grid pattern across the surface thereof which is therefore capable of having areas thereof individually addressed through the addressing wires. It is these wires which are accessed by the wires 38 of FIG. 1; that is, wires 38 comprise a plurality of individual wires providing addressing information to the magneto-optic chip 34. The magneto-optic chip 34 has the characteristic of being able to rotate a beam of light passing therethrough (called "Faraday" rotation). Since the light beam from the illumination source 14 is polarized by the polarizing sheet 32, Faraday rotation thereof by the magneto-optic chip 34 can cause the polarized light beam to be placed closer to alignment with the polarization analyzer sheet 36 or further out of alignment therewith depending on the direction of rotation. This Faraday rotation of the light beam is accomplished by the individual addressible areas of the magneto-optic chip 34. The areas are typically laid out in a regular rectangular grid pattern such that each addressible grid area becomes a pixel in a display image. If the light beam passing therethrough is rotated into closer alignment with the axis of the analyzer sheet 36, that area of the display will tend to be light in color while, if the area rotates its portion of the beam in the opposite direction, that portion of the display image will appear dark. As will be readily understood, therefore, the light beam 40 emerging from the magneto-optic display chip 16 comprises a regular pattern of light and dark according to the rotation pattern of the pixel areas of the magneto-optic chip 34 as dynamically changed by the display driver (not shown). Light beam 40 first strikes a half-silvered mirror 42 which, accordingly, acts as a beam splitter. One half of the light beam, 40′, is reflected from the mirror 42 while the second half, 40″, passes therethrough. A first mirror 44 is used to deflect the half beam 40′ towards one focusing lens 20. A second mirror 46 and a third mirror 48 are employed to reflect the second half beam 40″ through the second focusing lens 20. Accordingly, as the viewer 50 looks through the focusing lenses 20, he sees the dynamic display contained on light beam 40 simultaneously with both eyes.

Figure 2:
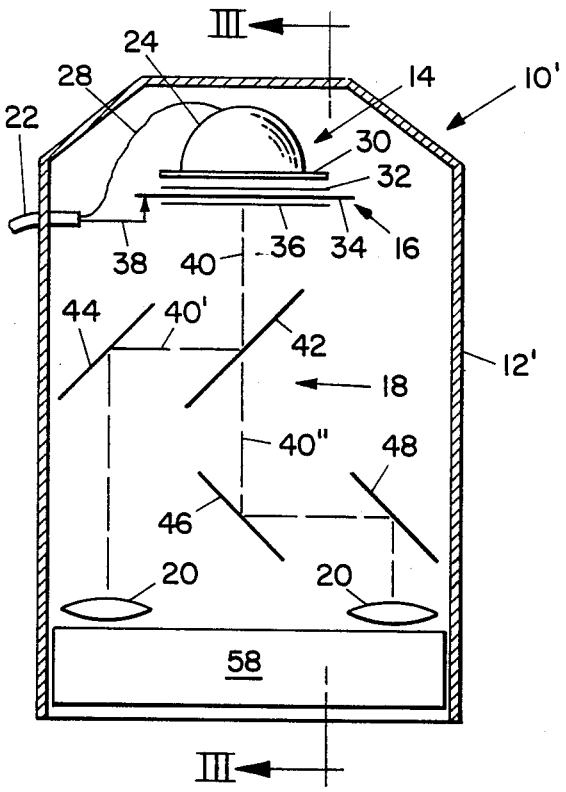
FIG. 2 is a cutaway front elevation of the display of FIG. 1 modified for vertical mounting and with the addition of a see-through half-silvered mirror in the line of sight for superimposing the display image upon the viewer's normal line of sight.
Figure 3:
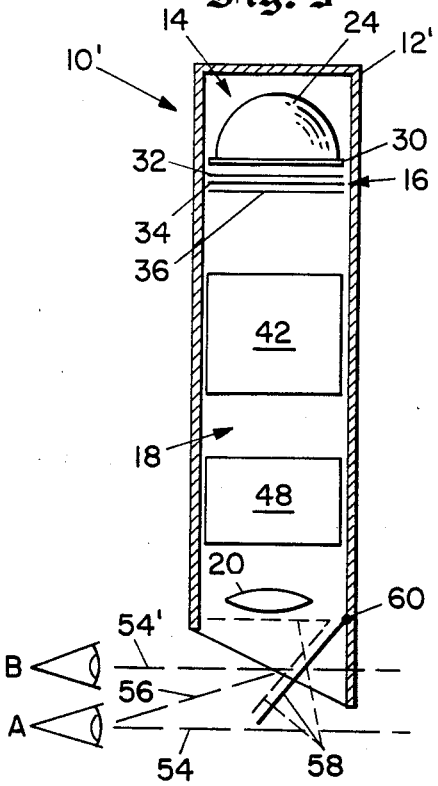
FIG. 3 is a cutaway side elevation of the display of FIG. 2 in the plane III—III.
Figure 4:
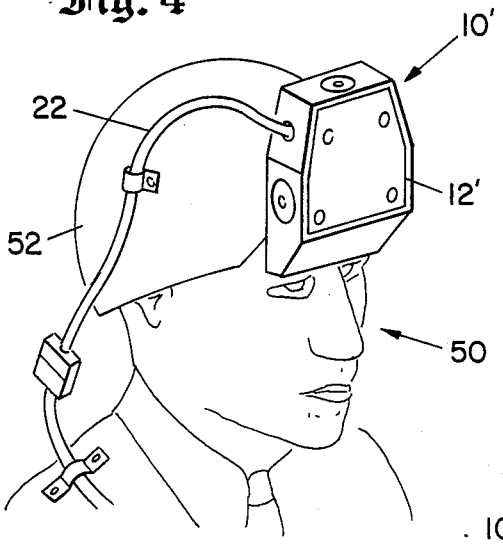
FIG. 4 is a perspective view of the display of FIGS. 2 and 3 mounted to a helmet being worn by a viewer.

Turning now to FIGS. 2–4, a second embodiment of the present invention is shown. Whereas the display 10 of FIG. 1 was intended for horizontal disposition in front of the eyes of the viewer with his eyes placed close adjacent and looking directly through the focusing lenses 20, the binocular display 10′ of FIGS. 2–4 is intended for vertical mounting and attachment to a helmet such as that indicated as 52 in FIG. 4 which can be worn on the head of the viewer 50. In this arrangement, the display 10′ can be utilized in either of two ways. In one, the viewer 50 has his eyes positioned as in position A of FIG. 3 and as shown in FIG. 4. That is, the eyes of the viewer 50 have a forward line of sight 54 below the bottom of the housing 12. To see the display, the viewer 50 need only glance up along line of sight 56. In an alternate embodiment, the display 10′ is positioned so that the eyes of the viewer 50 are at position B and the forward line of sight 54′ is through a half-silvered mirror 58. This latter arrangement causes the display from the display 10 to be superimposed on top of the normal forward vision 54' of the viewer 50. In either case, mirror 58 must be positioned as shown. The mirror 58 can be permanently affixed or, alternatively, it can be hinged at point 60 to be movable between the two dotted positions shown. When the mirror 58 is used with the viewer's eyes positioned at A in FIG. 3 and as shown in FIG. 4, the mirror 58 is preferably fully-silvered for complete reflection as opposed to its half-silvered state when used for a superimposed display.

Several modifications to the components within the housing 12 or 12' according to the embodiments heretofore described will now be described. For convenience, the housing 12/12' is omitted.

Additinally, it should be understood that if the source of illumination 14 is replaced with a high intensity projection light source and the focusing lens is a projection lens, any of the techniques described herein could be employed in a projection display sytem. Such techniques and the attendant considerations are well known in the art and are, therefore, not discussed further herein.

Figure 5:
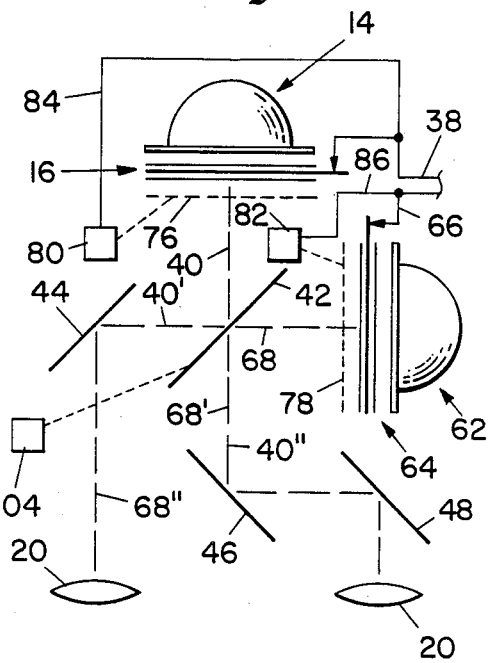
FIG. 5 is a simplified plan view of the elements of the display of the present invention in a second embodiment employing two superimposed display images.
Figure 6:
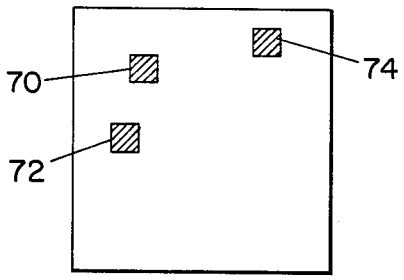
FIG. 6A and 6B show two exemplary simple complementary displays which are combined in the display apparatus of FIG. 5.
Figure 6:
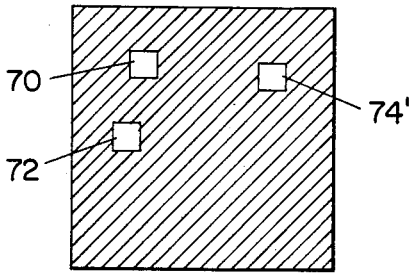
Figure 7:
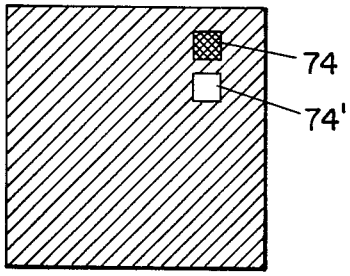
FIG. 7 is a simplified composite drawing showing the results of displays A and B of FIG. 6 being superimposed on one another.

Turning first to FIG. 5–7, a dual superimposed display is shown capable of providing more information. It should be understood that the displays being described hereinafter have particular utility to military personnel such as tank drivers and the like being fed positional information of stationary and slowly-moving targets and battle environments. The examples being described are constructed accordingly.

As the basic configuration described with respect to FIGS. 1 and 2 is viewed, it will be noted that the half-silvered beam splitting mirror 42 has an unused optic axis extending upward as FIG. 1 is viewed and extending to the right as FIG. 2 is viewed. By making use of this optic axis, a more sophisticated display can be created capable of conveying a greater amount of information. To accomplish this, a second source of illumination 62 and a second magneto-optic display chip 64 are mounted along the unused optic axis. This configuration is shown in FIG. 5. The second magneto-optic chip 64 is driven from a second display driver (not shown) through wires 66. By so doing, the binocular image appearing at the focusing lenses 20 can be the display from the first magneto-optic display chip 16, the display from the second magneto-optic display chip 64, or a superimposed combination of both. As can be seen, light beam 40 containing the display image superimposed thereon by display chip 16 is split by mirror 42 into half-level components 40' and 40". In like manner, the light beam 68 carrying the display information from second magneto-optic display chip 64 is split into half-level components 68' and 68". Thus, each focusing lens 20 is in line with a combined light beam comprising half of beam 40 and half of beam 68. The usefulness of this is shown in FIGS. 6 and 7.

The performance characteristics of either display panel 16, 64 can be reversed by simply reversing the current flow in the addressing wires fed by the wires 38, 66 from the display drivers (not shown). This condition is shown in FIG. 6. The A portion of FIG. 6 has a transparent background with positional representations shown darkened. The other display as shown in the B positin of FIG. 6 is reversed such that the background is darkened and the positional representations are light. Assume now that, for example, the display driver creating the image of display A is generated from prior information and that the display associated with position B is generated as a result of present information, the composite superimposed display seen by the viewer will appear as in FIG. 7. If the positional representations at 70 and 72 have not moved, the reversed light intensity of the A and B display images will blend as shown in FIG. 7 and the two positional representations 70, 72 will not appear to the viewer, thus indicating that no movement has taken place. On the other hand, assume that positional representation 74 from the "prior" display of A has moved to a new position in the "present" display of B as indicated therein as 74'. In the composite display of FIG. 7 as viewed by the observer, the lack of beam brightness at position 74 in both the A and B displays will cause the composite display to contain a darkened area at the prior position 74 while the superimposed area of brightness at new position 74' will create a high intensity area at positional representation 74, thus clearly indicating to the observer immediately that the only movement in the area has occurred from position 74 to 74'.

Figure 8:
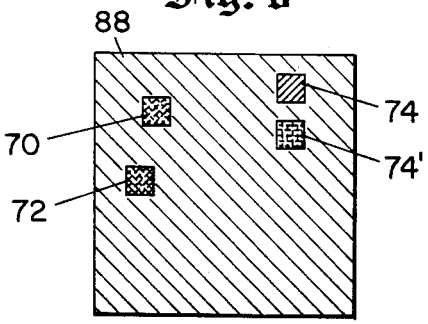
FIG. 8 is a simplified drawing of a composite display of the displays of FIG. 6 when they are accomplished with different colors.

A similar approach can be taken through the use of color filters as shown in FIG. 8. If, in the apparatus of FIG. 5, color filters 76 and 78 are placed in front of the display chips 16, 64, respectively, as shown dotted, highly informative displays can be created. In this case, the driving circuit signals are programmed to present different monochrome image intensity patterns on the two display chips 16, 64 and the different colors of the filters 76, 78 convert this intensity difference into a color difference, as is well known in additive color systems in general. Different colors may be used to distinguish between different types of displayed vehicle symbols, friendly and enemy troops and installations, roads and water features on maps, and so on.

Particularly versatile combined displays can be created if the color filters 76, 78 are of a changable variety, being changable by drivers 80, 82 operably connected thereto and being controlled by lines 84, 86 operably connected to wires 38, 66, respectively. By way of example, assume that the display of FIG. 5 is mounted for viewing by a tank driver. In a first position, the tank driver may have viewed the display of FIG. 7. He may then wish to see the entire image again, but with the changed information also highlighted. By pushbutton control (not shown), the drivers 80, 82 are activated such that one color filter 76 is changed to green while the other color filter 78 is changed to orange. The old information of FIG. 6A then becomes dark olive symbols on a light green background while the new information of FIG. 6B becomes light orange symbols on a dark brown background. The combined final image of FIG. 8 shows the unchanged symbols 70, 72 as an orange color on a green background 88 while the old position 74 is dark mustard-brown and its new position 74' is bright yellow.

Figure 9:
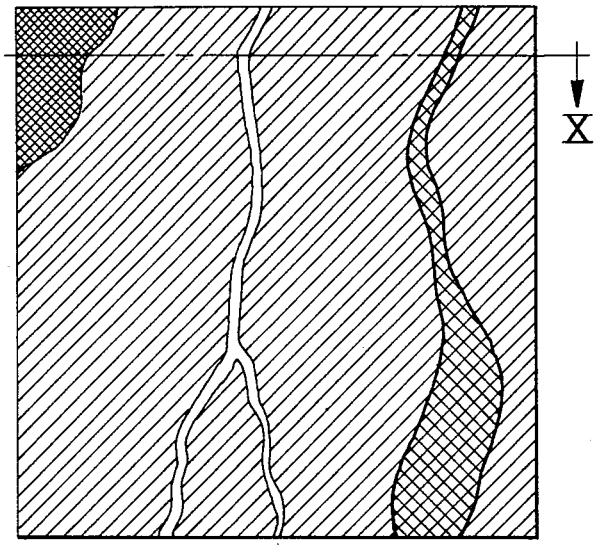
FIG. 9 shows a topographical display as can be created using the system of FIG. 5 when employing different light intensity levels in the two display generators thereof.
Figure 10:
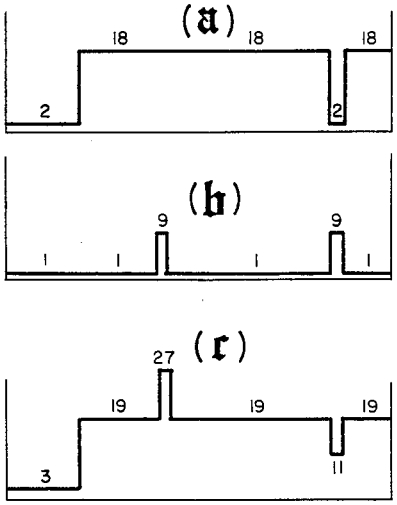
FIG. 10 is a graph of the individual light intensity levels employed to create the display of FIG. 9 along with a graph of their combined intensity levels.

Another variation can be created in the manner shown in FIGS. 9 and 10. In this embodiment, four levels of brightness for a limited halftone display are created by the use of two different bulb intensities in the illumination sources 14 and 62, respectively. For example, the display of FIG. 9 shows open terrain, in an intermediate monochrome intensity, while passable roads are a light shade, rivers and other bodies of water are darker, and impenetrable woods and cliffs are black. The brightness profile along the dotted line indicated as X is shown in foot-lamberts seen by each eye in FIGS. 10A and 10B with the combined intensity level shown at FIG. 10C. The display of FIG. 10A is twice the intensity of the display of FIG. 10B. Being fluctuations between 2 and 18 foot-lamberts in the former case and 1 and 9 foot-lamberts in the other case. As can be seen in the graph of FIG. 10C, the combined four levels of brightness become 3, 9, 19 and 27 foot-lamberts.

The two-display configuration of FIG. 5 has additional benefits. For example, it can be used in displaying changable range graticules, cursors, pointers, sub-titles, cross-hairs, or other overlying information, where it is preferrable from a system design viewpoint to use two separate display panels driven by two transmission channels having different characteristics, for the main display and the cursors. For example, small coordinate marker arrows can be received over a different channel and displayed on a different display than a map, or the map may be received information while the marker arrows may be generated by the tank driver for transmission back to the command hutch over another channel. Similarly, video information may be displayed on a serially-addressed bubble chip memory, and alphanumeric information displayed on a matrix-addressed chip to form a combined display where the serial and matrix signals are not compatible, and require separate transmission channels.

Another use for the two-display panel display is for moving target detection in a blink-comparator mode. Old and new information is stored on the display chips 16, 64, respectively, with the same polarity of magnetic storage and relative analyzer position, resulting in two displays of the same contrast polarity. The illuminator bulbs in the illumination sources 14, 62, respectively behind the two display panels 16, 64 are repeatedly switched on and off alternately, display 16 being on when display 64 is off and vice versa. Any display feature which does not "blink" or jump back and forth between two different locations is in the same position in the old and new images, while any picture elements which jump back and forth represent changes in the images between the old and new information samples. The two display times can be made unequal, to indicate quickly which is old and which is new information.

Figure 11:
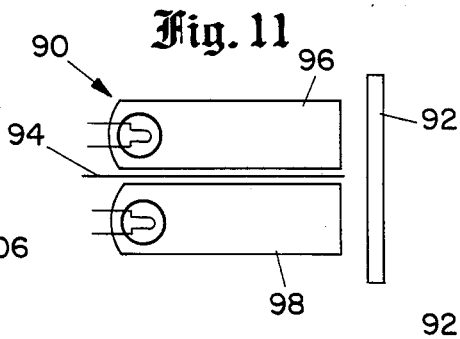
FIG. 11 is a simplified cutaway side elevation showing an alternate light source to be employed in the present invention to create a split-screen display.
Figure 12:
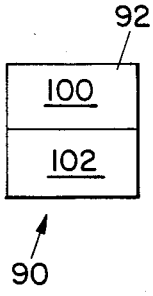
FIG. 12 is a front elevation view of the light source of FIG. 11.

Another possible variation can be created by using a split illumination source such as that indicated generally as 90 in FIGS. 11 and 12. The diffusion sheet 92 has placed behind it a separator 94 having a first bulb and reflector 96 on one side of the separator 94 and a second bulb and reflector 98 on the opposite side. By so doing, the diffusion sheet 92 can be illuminated in the upper half 100, the lower half 102 or both. In use, an image can be viewed on the top half of one display chip while the bottom half is darkened and erased. New informatin is then accumulated in the bottom half over a period of time and illuminated for display when ready. In another use, an image of an unidentified vehicle may be presented on the top half of a screen while a sequence of recognition silhouettes of friendly and enemy vehicles is presented on the bottom half for comparison. Similar benefits in various particular uses can be accomplished by other variations. For example, an illuminator could be provided with an L-shape, with multiple-illumination bands, or the like.

Those skilled in the art will recognize that unique effects can be created for particular needs by combining the various techniques heretofore described with respect to FIGS. 1–12.

Referring back to FIG. 5, once again, another adaptation providing additional benefits can be obtained by having the beam-splitting mirror 42 rotatable about its center as FIG. 5 is viewed, such as by the driver 104. By rotating the mirror 42 90° (or alternatively and preferably by removing it from the optic path of the system) a 3-D stereo view is created. This is because the right eye sees only the display from chip 16 while the left eye sees only the display from chip 64. The stereo effect can be obtained by the proper offsetting of the images through the electronic driving medium. The techniques necessary to create a three dimensional effect in simultaneously viewed images is well known in the art and is not discussed further herein.

Figure 13:
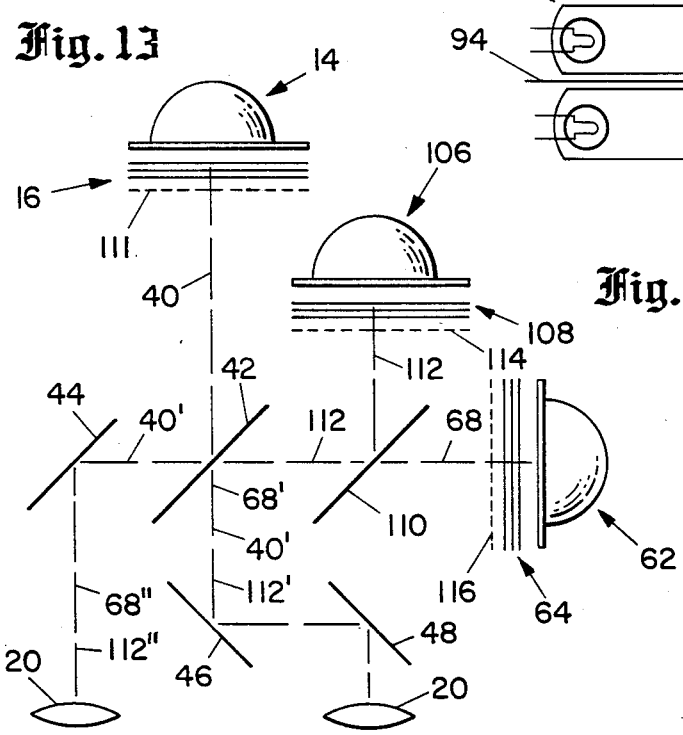
FIG. 13 is a simplified plan view of yet another variation of the display system of the present invention in which three displays are combined.

Turning now to FIG. 13, yet another embodiment capable of full color reproduction or eight-level grayscale (i.e., halftone) image generation is shown. To the configuration of FIG. 5, a third source of illumination 106 and third magneto-optic display chip 108 are added on the optic axis of the chip 64 in the manner shown. An additional half-silvered mirror 110 positioned between the chips 64 and 108 is also necessary. The use of the two beam splitter mirrors 42, 110 allows additive mixing of three primary color displays to achieve full color reproduction capability. The optical path lengths from each eye to each display chip 16, 64, 108 must be the same to provide superimposed in-focus images having the same magnification. Also, the brightness of the two displays 64, 108 will be halved at the half-silvered mirror 110 relative to the brightness of the display 16. This should be compensated for by adjusting the number of bulbs in the illuminators 62, 106 or by adjusting their currents or such. Color filters 111, 114, 116 act to restrict the color transmitted through each display to the desired primary colors which are then added by the beam splitters 42, 110 in the general manner of other additive color systems. Dichroic mirrors may also be used as could three sourced of illumination being, respectively, one each of the three primary colors chosed to be used. The signals which drive the three chips 16, 64, 108 are, of course, three electronic signals containing the separate color components of the composite signal which may display full-color images of maps and other information.

In the presently known materials employed in the display chips 16, 64, 108, the Faraday rotation employed therein and the optical absorption of the film both vary greatly with color. In a single film device, the choice of film thickness, lamp brightness and analyzer position are a compromise which favors yellow transmission since the film is too thick and absorptive to pass much blue light, and is, at the same time, too thin to have enough rotation of red light. However, on dividing the transmitted colors between three displays, a very great improvement in color properties can be expected by optimizig film thicknesses for the color to be transmitted. For example, one film type increases its rotation from 1.4 to 3.2 degrees per micron in the color range from about 635 to 550 nonometers, while the absorption coefficient increases from about 4 to $9\times10^2 cm^{-1}$ in the same range. This suggests that if the film thicknesses are adjusted to give the same optical transmissions for the three color channels, the films will have more closely comparable Faraday rotations with comparable good contrasts. One approximation to the desired thicknesses is to use 3, 10, and 30 micron thick films for blue, green and red primaries, respectively.

The bulb brightness in the illuminators 14, 62, 106, can also be increased for a dim blue primary channel and decreased for a bright red channel, to improve color balance or to use the same standard thickness for all three films. In addition, the three analyzier angles can be different, to separately optimize contrast. Finally, different film material compositions can, in principal, be developed to optimize the rotation/transmission figure of merit in each primary band of wavelengths, and a different choice of primaries, such as cyan, magenta and yellow may avoid the more extreme variations in optical properties.

Another capability of the three-chip device of FIG. 13 is the production of a gray scale or halftone image having eight levels of brightness. The display of FIGS. 9 and 10 showed that the superposition of two images of different brightnesses, each having two levels of brightness, results in four levels of brightness in the final image. Similarly, three bistable images may be superposed to give eight levels of brightness in the final image, and (n) images may be superimposed to give $2^n$brighthess levels. The three chips used may be of the same film thickness, producing monochrome displays without need of the color filters 111, 114, 116, which are removed. If the bulbs are adjusted to give brightnesses of 1, 2, and 4 foot-lamerts, respectively, from chips 16, 64, and 108, in the written condition, then picture elements from the three chips can be combined to produce brightnesses from 1 through 7 fl., plus the background brightness of all three chips in the erased condition, as is known in binary addition. The resulting eight levels of brightness provides a display which is adequate for the depiction of shaded video scenes in many application. Further beam splitting, as would occur with the introduction of another half-silvered mirror close to chip 16, and another display chip and illuminator in its other optic axis, could of course be accomplished and would double the number of brightness levels to 16.

Figure 14:
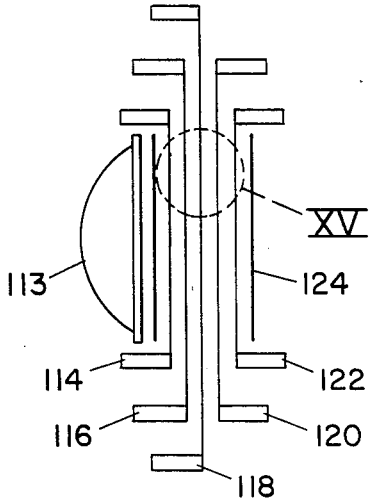
FIG. 14 is a simplified plan view of a display generator which can be employed within the display system of the present invention in its various embodiments to create gray scale shading.
Figure 15:
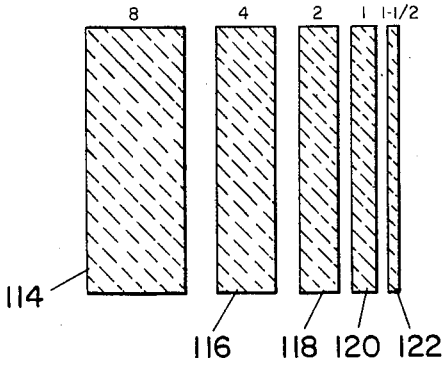
FIG. 15 is a cutaway enlarged view through the display generator of FIG. 14 in the area designated as XV.

Instead of adding a fourth, fifth and sixth chip and illuminator to get 16, 32, and 64 brightness levels, however, the chip configuration of FIG. 14 can be employed and will provide a multi-level gray scale image in a smaller housing without the extra half-silvered mirrors and illuminators. Only a single channel and single illuminator 113 are needed, as in the simpler devices of FIGS. 1, 2, and 3, but several chips 114, 116, 118, 120 and 122 are placed together in front of the illuminator. FIG. 15 shows enlarged the use of the five chips 114, 116, 118, 120 and 122 placed together and having film thicknesses of 8, 4, 2, 1 and ½ microns, respectively, giving Faraday rotations of 8, 4, 2, 1 and ½ degrees in either the left or right handed direction, when written in the corresponding direction. The combination of rotations available by the stack with respect to the analyzer sheet 124 will be recognized as the combinations of a five digit binary arithmetic, or 32 different sums, i.e., 2 to the fifth power. These 32 different directions of polarization all have slightly different projection cosines at the analyzer 124. These 32 different intensities provide the grey scale, of halftones, of the display, when the driving signals are programmed to provide parallel channel binary coded digital brightness information. Three such stacks can be used in a three-optical-channel display to provide full color and halftones, together. The grayscale techniques of FIGS. 14 and 15 as well as additional techniques for achieving a broad dynamic range from magneto-optic chip can be seen in detail in co-pending application Ser. No. 375,321, filed May 5, 1982 titled MAGNETO-OPTIC CHIP WITH GRAY SCALE CAPABILITY by R. H. Anderson, W. E. Ross, and T. R. Maki which is assigned to the assignee of this application.

In the foregoing approach, it should be noted that the addition of any number of display chips to obtain more levels of brightness quantizing, for increased uniformity, does not increase the total film thickness beyond two times that of the thickest film, since the total thickness is proportional to a partial sum of a well known geometric series. This sets a limit on the optical absorption which occurs in the chip stack, which the designer chooses.

In this method of generating halftones, the images on different chips are combined prior to converting polarization differences to intensity differences at the analyzer 124. This may be contrasted to the method of FIG. 13 in which polarization differences are first converted to intensity differences, in different optical channels, and then combined. In the multi-channel method, additional illuminators and beam splitters are required, but each display "sandwich" is relatively simple. In this stacked-chip method, only one illuminator and beam splitter are needed, but the chip mounting boards and connectors may need to be made in several different sizes in order to be nested together, as shown in profile in FIG. 14.

An alternative compromise or hybrid design would be to use the two-channel configuration of FIG. 5, where each illuminator would then have two or three chips in front of it, and both types of gray scale generation would be used. A sixteen level display could be generated using one size of circuit board and two film thicknesses (two chips of each thickness) by dimming one illuminator so that its chips contribution to brightness are in the right range. This would also permit considerable latitude in selecting among available chips. For example, if chips having rotations of 10, 8, 2½ and 2 degrees are available, the 8 and 2 can be paired in front of one illuminator, while the 10 and 2½ are paired with the other illuminator at reduced brightness, supplying the binary quantities 4 and 1. There is also the possibility of making a single type of chip having an 8 micron thick layer on one side of the substrate and a 4 micron layer on the other side. The use of this one type of chip in either a two or three optical channel display goggle, with different illuminator intensities, would give either 16 or 64 levels of brightness, respectively.

Figure 16:
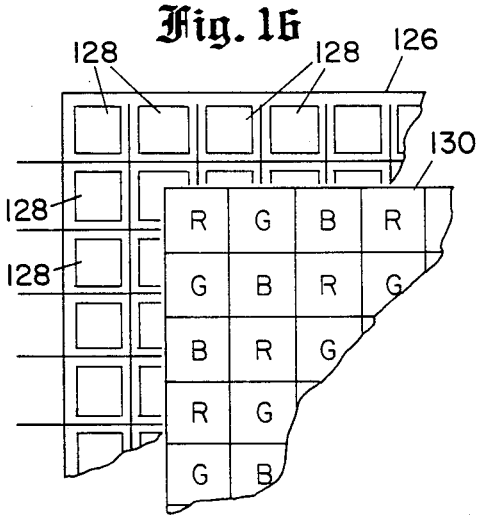
FIG. 16 is an enlarged view of a portion of the magneto-optic chip employed in the displays of the present invention with a color filter covering of one form which could be used in the generation of color displays.
Figure 17:
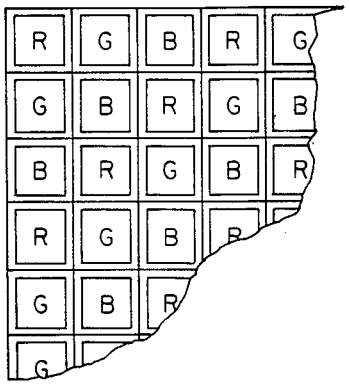
FIG. 17 shows the magneto-optic chip portion of FIG. 16 with the filter sheet in place thereon.

The simpler one-channel one-chip display goggle configuration of FIGS. 1, 2 and 3 also has both color and gray scale possibilities. FIG. 16 shows a "standard" display chip 126 having its usual array of storage posts 128 and, also, shows a color transparency 130 having red, green and blue colored squares to be matched to the posts 128. Any combination of first, second, and third primary colors could, of course, be used. FIG. 17 shows the transparency 130 registered over the posts 128, so that each post 128 contributes only one primary color to the display. A cluster of three posts 128 in a horizontal row (or three vertically, or an L-shaped group) can constitute an element of resolution of the image.

Figure 18:
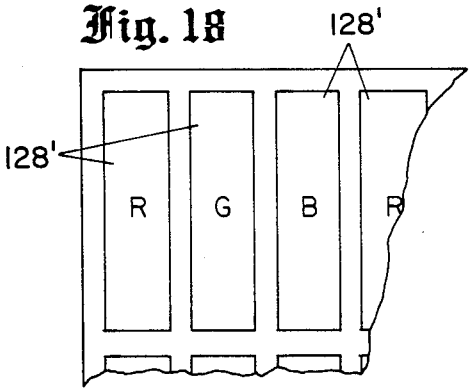
FIG. 18 is an enlarged portion of a corner of a magneto-optic chip employed for color display generation in a second embodiment.
Figure 19:
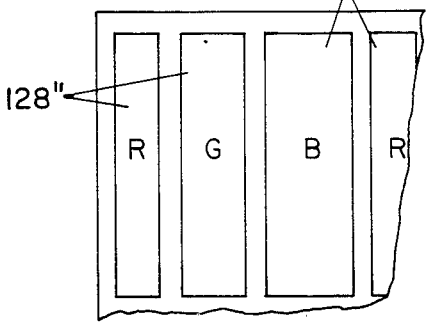
FIG. 19 is also a corner of a magneto-optic chip employed for color display generation in yet a third possible embodiment.

Those arrangements, however, result in unequal horizontal and vertical resolution. This can be corrected by changing the aspect ratio of the posts 128', so that the cluster comprising the element of resolution is square, or nearly so, as shown in FIG. 18. In FIG. 19, the area of the posts 128'' has been changed to improve color balance by devoting more area to the dim blue color and less to the relatively bright red. This improvement can also be achieved by using a standard square post format, but devoting two posts to the blue, where both are diven by the same signal (and the two blue areas can alternatively be in the same row or column, to simplify circuit design, if wanted). The red may be attenuated by placing a blue-green filter over the whole chip or by adding a neutral filter having gray squares only covering the red posts. These gray squares can be incorporated in the color filter by using a grayed red color. In this arrnagement, the element of resolution is the square cluster of four square posts.

It is also possible to improve color balance in the single-chip configuration by using posts of different thickness, the red, green and blue posts being thickest, intermediate and thinnest in that order. Selective etching by photochemical techniques should make this possible. It is also conceivable to make different posts on a chip of different materials, either by originally depositing them that way or by altering their composition by selective ion-bombardment or chemical leaching of some constituants. The improvement obtained by separately tailoring the optical properties of the material for the color to be transmitted was mentioned in connection with the three-channel three-chip color display of FIG. 13 where it is easier to implement, since each film of posts has one composition. Where it is imperative to use only one optical channel and illuminator, in a very compact instrument where color is wanted, and materials optimization is also wanted, a configuration made with some posts omitted, could be employed. The posts on each chip are made of different materials, and are placed so that no post is under another post when the chips are stacked up. The front view of the stack of chips is the same as in FIG. 17, but the posts for each color are on a different chip.

Some further improvement in brightness, contrast and color balance may also be available by using different analyzer angles for different primary color posts. It may be possible to fabricate a checkerboard of polarizer elements or half-wave retardation plates to register with the posts, but a more practical configuration is the utilization of a sheet polarizer having apertures over the posts and color filters for two primary colors, but covering the remaining posts and color filter. Two other apertured sheet polarizers would be patterned to each cover only one of the other sets of posts, and the three sheets would be used either for polarizers or analyzers. Alternatively, three half-wave retardation plates may be patterned as described and used together with plain, non-apertured polarizer and analyzer. The webs between apertures may be avoided in the preceding concepts, by attaching the polarizer to a transparent substrate before structuring it.

Halftones (gray scale) can also be obtained from a single chip. Sixteen levels of brightness can be obtained by using a cluster of four posts for the picture element. A transparency having a pattern of clear and gray squares is prepared, where families of squares 1, 2, 3, and 4 are placed over the posts, and they are clear, light gray, darker gray and still darker gray, in that order. Binary quantized brightness signals control the selection of written posts to form any possible combination of the four bistable posts brightnesses within a picture element, for veiwing conditions which do not (or marginally do) resolve the posts, within the picture element. The optical transmissions of the families of squares 1, 2, 3, and 4 in the transparency are in the ratio 8, 4, 2 and 1, so that any combination of 0 to 15 can be made, with suitable programming.

It will be realized that the use of one chip to get color, halftones or image processing results in lower total resolution for a given chip size, but uses fewer optical channels and components than the multi-channel viewers which have higher resolution. The choice is a matter of system design.

Another possibility for image processing uses is to place the display chip over an LED array with each post illuminated by one diode. When one image is written on the LED array and a second image is writted on the L-135 chip, light will be transmitted to the final display only where both images coincide, so an image coincidence display results.

Figure 20:
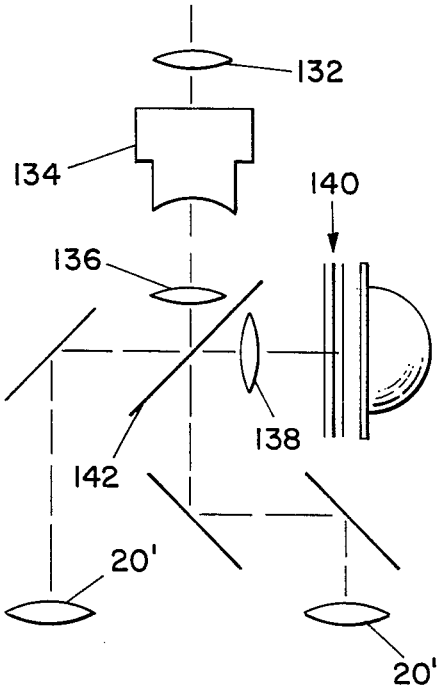
FIG. 20 is simplified plan view of a display according to the present invention combined with a night vision intensifier.
Figure 21:
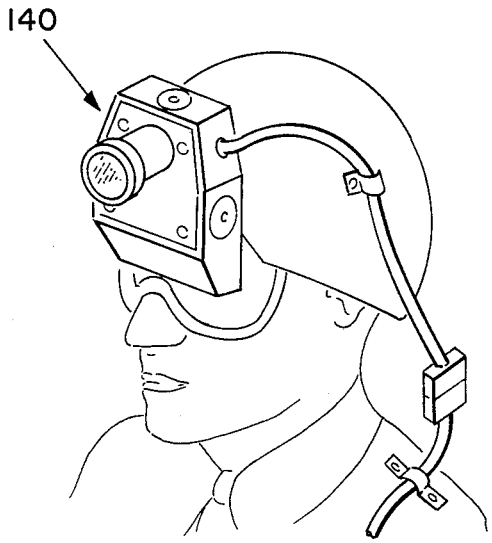
FIG. 21 is a perspective view of the display system of FIG. 20 mounted to a helmet on an observer.
Figure 22:
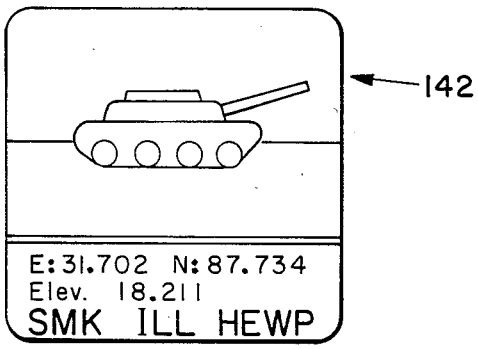
FIG. 22 is a simplified drawing of the type of display as would be seen by the observer of FIG. 21 empmloying the combined night vision/display system of FIG. 20.

The new model of night-vision goggles by the assignee of this application uses a single intensifier tube viewed by a bifurcated eyepiece. Such a device should be compatible with the multi-channel eyepiece described herein, providing the ability to superimpose an image of maps, alpha-numerics, cursors, etc., over a night scene in front of the viewer. Such a composite device is shown in simplified form in FIG. 20. Distant objects are imaged by lens 132 onto image intensifier tube 134, and the intensified image is reimaged by lens 136. The image formed by lens 136 is located between lens 136 and focusing lenses 20', which may have a different power than in the above-described devices. The change in lenses 20' may require an added lens 138 to image the display chip 140, combining its image with that of the intensifier 134 by means of the half-silvered mirror 142. Various types of prisms may, of course, be used in place of the mirrors. This hybrid goggle 140 and its display 142 are shown in FIGS. 21 and 22, respectively.

In the devices described, the polarization analyzer can be near the chip, near the observer's eyes, or anywhere in between. There are also a number of possible similar configurations having various placements of the half-silvered mirror which defines the branching point of the optical system. Different sizes of chips can be used, forming images which only partly overlap. Different magnifications may be employed in different optical channels of the system by using lenses or focusing mirrors in those channels. The bifurcated eyepiece may be used together with a display chip in one channel and a slide transparency, cathode ray tube, LED display, liquid crystal display, fiber optic image or rear projection display in the other channel. One or both channels can employ the switchable "tandem-chip" arrangement or the "image processor" arrangement. In those embodiments in which two images are combined, the same kind of images can be formed by projecting the chips together on a front-viewing or rear-viewing screen with two slide projectors or an equivalent two-slide single projector.

Wherefore, having thus described my invention, I claim:

1. A binocular magneto-optic display comprising:

(a) a source producing a first beam of light;

(b) first polarizer means disposed in said first beam for polarizing the light of said first beam:

(c) first magneto-optic chip means disposed in said first beam after said first polarizer means for selectively altering the axis of polarization of said first beam passing through addressible areas of said first chip, said first chip including means adapted to be operably connected to a first display driver for addressing said addressible areas whereby said first chip can be driven to alter the axes of polarization of said areas as a function of a desired first display;

(d) first polarization analyzer means disposed in said first beam after said first chip means for blocking or passing portions of said first beam corresponding to respective ones of said areas through which they have passed as a function of said altering of the axes of polarization performed by said respective ones of said areas whereby said desired first display is imparted into first light beam;

(e) first beam splitter means disposed in said first beam for splitting said beam into first and second partial-intensity beams;

(f) focusing means disposed in said first and second partial-intensity beams for viewing said first display contained within said first and second partial-intensity beams; and, (g) second beam splitter means disposed in said first and second partial-intensity beams after said focusing means whereby a viewer can look through said second beam splitter means and see said display superimposed on a normal field of vision.

2. The binocular display of claim 1 wherein:

said second beam splitter is mounted for movement between said position disposed in said first and second beam and a position removed from both the viewer's line of sight and said beam.

3. The binocular display of claim 1 and additionally comprising:

reflector means disposed for movement between a first position for directing said first beam into the line of sight of a view and a second position out of said viewer's line of sight.

4. The binocular display of claim 1 or claim 2 or claim 3 and additionally comprising:

housing means for containing components of the display and including means for attaching said housing means to the head of a viewer.

5. The binocular display of claim 1 and additionally comprising:

(a) a source producing a second beam of light;

(b) second polarizer means disposed in said second beam for polarizing the light in said second beam;

(c) second magneto-optic chip means disposed in said second beam after said second polarizer means for selectively altering the axis of polarization of said second beam passing through addressible areas of said second chip, said second chip including means adapted to be operably connected to a second display driver for addressing said addressible areas whereby said second chip can be driven to alter the axes of polarization of said areas as a function of a desired second display;

(d) second polarization analyzer means disposed in said second beam after said second chip means for blocking or passing portions of said second beam corresponding to respective ones of said areas through which they have passed as a function of said altering of the axes of polarization performed by said respective ones of said areas whereby said desired second display is imparted into said second light beam; and wherein, (e) said first beam splitter means is disposed in both said first and second beams whereby said first and second beams are split into first, second, third, and fourth partial-intensity beams, respectively, with said first and third and said second and fourth partial-intensity beams being superimposed upon one another.

6. The binocular display of claim 5 and additionally comprising:

(a) a first colored light filter disposed in said first beam of light prior to said first beam splitter means; and, (b) a second colored light filter disposed in said second beam of light prior to said first beam splitter means, said second filter being of a different color from said first filter.

7. The binocular display of claim 6 wherein:

(a) said first and second light filter are changeable filters; and additionally comprising, (b) means operably connected to said first and second filters for changing them.

8. The binocular display of claim 5 wherein:

(a) said first beam splitter is movable from its position for splitting said first and second beams to a second position removed from the path of said beams whereby when said first beam splitter is in said second position the display can be used to produce stereo image displays; and additionally comprising, (b) means for moving said first beam splitter between said positions.

9. The binocular display of claim 5 wherein:

said first and second sources of light are of different intensities whereby a superimposed display of four intensity levels can be created.

10. The binocular display of claim 5 and additionally comprising:

(a) a source producing a third beam of light;

(b) third polarizer means disposed in said third beam for polarizing the light in said third beam;

(c) third magneto-optic chip means disposed in said third beam after said third polarizer means for selectively altering the axis of polarization of said third beam passing through addressible areas of said third chip, said third chip including means adapted to be operably connected to a third display driver for addressing said addressible areas whereby said third chip can be driven to alter the axes of polariztion of said areas as a function of a desired third display;

(d) third polarization analyzer means disposed in said third beam after said third chip means for blocking or passing portions of said third beam corresponding to respective ones of said areas through which they have passed as a function of said altering of the axes of polarization performed by said respective ones of said areas whereby said desired third display is imparted into said third light beam; and, (e) second beam splitter means disposed in said third beam and in said second beam before said first beam splitter means for splitting said second and third beams and superimposing them prior to their striking said first beam splitter means.

11. The binocular display of claim 1 wherein:

said first magneto-optic chip means comprises a plurality of individually addressible magneto-optic chips whereby several display portions on respective ones of said chips can be combined into a single display.

12. The binocular display of claim 11 wherein:

said plurality of chips are in increasing thickness so as to be sequential members of a binary sequence starting one, two, four, eight with relation to one another.

13. The binocular display of claim 1 and additionally comprising:

color filter means disposed with first, second, and third primary color areas in registration over adjacent respective ones of said addressible areas in a pattern for providing individually addressible clusters of first, second, and third primary colored light passage whereby a full-color display can be created by allowing light passage through combinations in individual color portions of said clusters.

14. The binocular display of claim 13 wherein:

said pattern is a fixed repeating pattern.

15. The binocular display of claim 13 wherein:

said addressible areas and said areas of said color filter means have a length-to-width ratio of 3:1 whereby each of said clusters forms a square.

16. The binocular display of claim 13 wherein:

said addressible areas and said areas of said color filter means have a length-to-width ratio of 6:1 for the first primary color, 3:1 for the second primary color, and 2:1 for the third primary color whereby each of said clusters forms a square and the intensity of the primary colors is balanced.

17. The binocular display of claim 1 and additionally comprising:

(a) light intensifier means for receiving incoming low-intensity light, amplifying, and producing an amplified beam of light; and wherein, (b) said first beam splitter means is disposed in both said amplified light beam and said first light beam whereby both said beams are split into partial-intensity beams and respective ones of said partial-intensity beams are superimposed on one another at said focusing means.

18. A magneto-optic projectable binocular display comprising:

(a) a source producing a first beam of light;

(b) first polarizer means disposed in said first beam for polarizing the light said first beam;

(c) first magneto-optic chip means disposed in said first beam after said first polarizer means for selectively altering the axis of polarization of said first beam passing through addressible areas of said first chip, said first chip including means adapted to be operably connected to a first display driver for addressing said addressible areas whereby said first chip can be driven to alter the axes of polarization of said areas as a function of a desired first display;

(d) first polarization analyzer means disposed in said first beam after said first chip means for blocking or passing portions of said first beam corresponding to respective ones of said areas through which they have passed as a function of said altering of the axes of polarization performed by said respective ones of said areas whereby said desired first display is imparted into said first light beam;

(e) a source producing a second beam of light;

(f) second polarizer means disposed in said second beam for polarizing the light in said second beam;

(g) second magneto-optic chip means disposed in said second beam after said second polarizer means for selectively altering the axis of polarization of said second beam passing through addressible areas of said second chip, said second chip including means adapted to be operably connected to a second display driver for addressing said addressible areas whereby said second chip can be driven to alter the axes of polarization of said areas as a function of a desired second display;

(h) second polarization analyzer means disposed in said second beam after said second chip means for blocking or passing portions of said second beam corresponding to respective ones of said areas through which they have passed as a function of said altering of the axes of polarization performed by said respective ones of said areas whereby said desired second display is imparted into said second light beam; and, (i) means for focusing said first and second beams.

19. The projectable display of claim 18 in which said focusing means further includes means for directing said first and second beams to combine in focus at a point of focus.

20. The projectable display of claim 19 additionally comprising color filter means disposed with first, second, and third primary color areas in registration over adjacent respective ones of said addressible areas in a pattern for providing individual addressible clusters of first, second, and third primary colored light passage whereby a full-color display can be created by allowing light passage through combinations and individual color portions of said clusters.

21. The projectable display of claim 20 wherein: said pattern is a fixed repeating pattern.

22. The projectible display of claim 20 wherein said plurality of chip layers have different thicknesses whereby said portions are of differing intensities and said combined single display is comprised of a plurality of different light intensity areas.

23. The projectible display of claim 20 wherein:

said addressible areas and said areas of said color filter means have a length-to-width_ratio of 3:1 whereby each of said clusters forms a square.

24. The display of claim 20 wherein:

said addressible areas and said areas of said color filter means have a length-to-width ratio of 6:1 for the first primary color, 3:1 for the second primary color, and 2:1 for the third primary color whereby each of said clusters forms a square and the intensity of the primary colors is balanced.

25. The projectable display of claim 19 wherein said directing and focusing means comprises:

(a) means disposed in said first and second light beams for combining portions of said first and second light beams into a combined beam containing said first and second displays; and, (b) focusing means disposed in said combined beam for focusing said combined beam at a point of viewing.

26. The projectible display of claim 25 and additionally comprising:

(a) a first colored light filter disposed in said first beam of light prior to said first beam combining means; and, (b) a second colored light filter disposed in said second beam of light prior to said first beam combining means, said second filter being of a different color from said first filter.

27. The projectible display of claim 26 wherein:

(a) said first and second light filters are changeable filters; and additionally comprising, (b) means operably connected to said first and second filters for changing them.

28. The projectible display of claim 25 wherein:

(a) said first beam combining means is movable from its position for combining said first and second beams to a second position removed from the path of said beams whereby when said first beam combining means is in said second position the display can be used to project stereo image displays; and additionally comprising, (b) means for moving said first beam combining means between said positions; and, (c) second focusing means for focusing a beam of light at a viewing surface, said first focusing means being disposed in said first beam and said second focusing means being disposed in said second beam.

29. The projectible display of claim 19 wherein:

said first and second sources of light are of different intensities whereby a superimposed display of four intensity levels can be created.

30. The projectible display of claim 25 and additionally comprising:

(a) a source producing a third beam of light;

(b) third polarizer means disposed in said third beam for polarizing the light in said third beam;

(c) third magneto-optic chip means disposed in said third beam after said third polarizer means for selectively altering the axes of polarization of said third beam passing through addressible areas of said third chip, said third chip including means adapted to be operably connected to a third display driver for addressing said addressible areas whereby said third chip can be driven to alter the axes of polarization of said areas as a function of a desired third display;

(d) third polarization analyzer means disposed in said third beam after said third chip means for blocking or passing portions of said third beam corresponding to respective ones of said areas through which they have passed as a function of said altering of the axes of polarization performed by said respective ones of said areas whereby said desired third display is imparted into said third light beam; and, (e) second beam combining means disposed in said third beam and in said second beam before said first beam combining means for combining portions of said second and third beams for superimposing them prior to their entering said first beam combining means.

31. The projectable display of claim 19 wherein said first beam of light being a first primary color, said second beam of light being a second primary color, and additionally comprising:

(a) a source producing a third beam of light being a third primary color;

(b) third polarizer means disposed in said third beam for polarizing the light in said third beam;

(c) third magneto-optic chip means disposed in said third beam after said third polarizer means for selectively altering the axes of polarization of said third beam passing through addressible areas of said third chip, said third chip including means adapted to be operably connected to a third display driver for addressing said addressible areas whereby said third chip can be driven to alter the axes of polarization of said areas as a functiopn of a desired third display; and (d) third polarization analyzer means disposed in said third beam after said third chip means for blocking or passing portions of said third beam corresponding to respective ones of said areas through which they have passed as a function of said altering of the axes of polarization performed by said respective ones of said areas whereby said desired third display is imparted into said third light beam and combined with said first and second beams.

32. The projectable display of claim 18 wherein said first magneto-optic chip means additionally comprises a plurality of individually addressible magneto-optic chip layers whereby several display portions on respective ones of said chip layers can be combined into a single display.

33. The projectable display of claim 18 additionally comprising a transparancy disposed over the pixel areas of at least one of said magneto-optic chip means said transparancy having a pattern of clear and increasingly gray areas over respective ones of said pixels wherein the pattern is one with optical transmissions in a binary sequence beginning one, two, four, eight.–

34. The full-color projection display of claim 31 wherein said combing and focusing means comprises:

(a) first combining means disposed in said first and second light beams for combining portions of said first and second light beams into a combined beam containing said first and second displays;

(b) second beam combining means disposed in said third beam and is said second beam before said first beam combining means for combining portions of said second and third beams and superimposing them prior to their entering said first beam combining means; and, (c) focusing means disposed in the combined first, second, and third beams for focusing said combined beam at a point of viewing.

* * * * *